US008365548B2

(12) United States Patent
Han et al.

(10) Patent No.: US 8,365,548 B2
(45) Date of Patent: Feb. 5, 2013

(54) ICE DISPENSING TECHNOLOGY

(75) Inventors: Seung Do Han, Seoul (KR); Dong Jeong Kim, Seoul (KR); Ho Youn Lee, Seoul (KR); Young Jin Kim, Seoul (KR); Tae Hee Lee, Seoul (KR); Sung Yong Shin, Seoul (KR)

(73) Assignee: LG Electronics Inc., Seoul (KR)

( * ) Notice: Subject to any disclaimer, the term of this patent is extended or adjusted under 35 U.S.C. 154(b) by 918 days.

(21) Appl. No.: 12/473,449

(22) Filed: May 28, 2009

(65) Prior Publication Data

US 2010/0131105 A1 May 27, 2010

(30) Foreign Application Priority Data

Nov. 24, 2008 (KR) ..... 10-2008-0116616

(51) Int. Cl.
*F25C 5/18* (2006.01)
*F25C 5/16* (2006.01)

(52) U.S. Cl. ..... 62/344; 62/381

(58) Field of Classification Search ..... 62/344, 62/354, 381, 137, 135
See application file for complete search history.

(56) References Cited

U.S. PATENT DOCUMENTS

| | | | | |
|---|---|---|---|---|
| 2,735,591 | A * | 2/1956 | Branchflower | 222/405 |
| 3,744,679 | A * | 7/1973 | Nitschneider et al. | 222/238 |
| 4,412,429 | A * | 11/1983 | Kohl | 62/347 |
| 6,607,096 | B2 * | 8/2003 | Glass et al. | 222/1 |
| 6,952,936 | B2 * | 10/2005 | Sannasi et al. | 62/344 |
| 2004/0163405 | A1 * | 8/2004 | Jung | 62/344 |
| 2004/0261442 | A1 * | 12/2004 | Chung et al. | 62/344 |
| 2005/0072166 | A1 | 4/2005 | Lee et al. | |
| 2005/0241330 | A1 * | 11/2005 | Son | 62/344 |
| 2006/0016209 | A1 | 1/2006 | Cole et al. | |
| 2007/0119204 | A1 * | 5/2007 | Kwon | 62/340 |
| 2008/0072610 | A1 | 3/2008 | Venkatakrishnan et al. | |
| 2009/0045213 | A1 * | 2/2009 | Dirnberger et al. | 221/154 |
| 2010/0132396 | A1 * | 6/2010 | Kato et al. | 62/344 |
| 2010/0313593 | A1 | 12/2010 | Lee et al. | |
| 2012/0036882 | A1 * | 2/2012 | Park et al. | 62/344 |

FOREIGN PATENT DOCUMENTS

| | | | |
|---|---|---|---|
| CN | 1975296 | A | 6/2007 |
| EP | 1522805 | A1 | 4/2005 |
| WO | WO 2008/050991 | A2 | 5/2008 |

OTHER PUBLICATIONS

Chinese Office Action dated Nov. 25, 2010 for Application No. 200910147521.9, with English Translation, 11 pages.
European Search Report dated May 6, 2011 for Application No. EP09006547, 6 pages.

* cited by examiner

*Primary Examiner* — Ljiljana Ciric
*Assistant Examiner* — Alexis Cox
(74) *Attorney, Agent, or Firm* — Fish & Richardson P.C.

(57) ABSTRACT

An ice making apparatus for a refrigerator, in which an ice bank stores ice and has an opening that discharges ice on its one side. An ejector opens and closes the opening and is rotatably provided at the opening to also eject ice from the ice bank. After completion of an ice discharging operation, a sensor senses a relative position of the ejector against the ice bank and the ejector is controlled to close the opening to the extent necessary.

20 Claims, 6 Drawing Sheets

ICE DISPENSING TECHNOLOGY

CROSS-REFERENCE TO RELATED APPLICATIONS

The present application claims priority under 35 U.S.C. 119 and 35 U.S.C. 365 to Korean Patent Application No. 10-2008-0116616, filed on Nov. 24, 2008, which is hereby incorporated by reference as if fully set forth herein.

FIELD

The present disclosure relates to ice dispensing technology.

BACKGROUND

In general, a refrigerator is an apparatus that maintains a freezing chamber or a refrigerating chamber at a relatively low temperature using a refrigeration cycle that generates cold air. The refrigeration cycle includes a compressor, a condenser, an expander and an evaporator.

Some refrigerators have an ice making apparatus that makes ice using cold air of the freezing chamber and a dispenser that allows the ice to be dispensed to an exterior of the refrigerator, without opening a door that opens and closes the freezing chamber.

SUMMARY

In one aspect, an ice making apparatus for a refrigerator includes an ice maker configured to make ice, a dispenser configured to dispense ice, and an ice bank that is configured to store ice made by the ice maker and that has an opening that enables passage of ice from within the ice bank to the dispenser. The ice making apparatus also includes an ejector that is configured to open and close the opening and that is configured to rotate to promote movement of ice from within the ice bank toward the opening, and a sensor that is configured to sense a position of the ejector relative to the opening of the ice bank. The ice making apparatus further includes a controller that is configured to, in response to completion of an ice dispensing operation, determine whether the ejector closes the opening of the ice bank based on output from the sensor and that is configured to, in response to a determination that the ejector does not close the opening of the ice bank, control the ejector to rotate to a position in which the ejector closes the opening of the ice bank.

Implementations may include one or more of the following features. For example, the ejector may include a plurality of blades that extend radially from a center of a rotation shaft of the ejector. The sensor may include a magnet provided on one of the ice bank and the ejector and a hall sensor that is provided on the other of the ice bank and the ejector and that is configured to sense strength of an electric field of the magnet.

The ice bank may include a housing that defines an external appearance of the ice bank and that defines a space in which ice is stored. The ice bank also may include an inclined portion that defines a bottom surface of the ice bank and that is inclined in a manner that guides ice stored in the ice bank toward the opening by force of gravity.

In some implementations, the ejector may be configured to rotate in a first direction to promote movement of ice from within the ice bank toward the opening. In these implementations, the controller may be configured to, in response to a determination that the ejector does not close the opening of the ice bank, control the ejector to rotate in a second direction to a position in which the ejector closes the opening of the ice bank. The second direction may be opposite of the first direction.

In some examples, when the controller controls the ejector to rotate to a position in which the ejector closes the opening of the ice bank, the controller may be configured to determine whether ice interferes with rotation of the ejector to the position in which the ejector closes the opening of the ice bank and the controller may be configured to, in response to a determination that ice interferes with rotation of the ejector to the position in which the ejector closes the opening of the ice bank, control the ejector to perform an ice removal operation in which the ejector rotates alternately in a first direction and a second direction that is opposite of the first direction. In these examples, the controller may be configured to determine whether, subsequent to completion of the ice removal operation, ice continues to interfere with rotation of the ejector to the position in which the ejector closes the opening of the ice bank. A warning part may be configured to display an error message in response to a determination that, subsequent to completion of the ice removal operation, ice continues to interfere with rotation of the ejector to the position in which the ejector closes the opening of the ice bank. Further, in these examples, the controller may be configured to determine whether, subsequent to completion of the ice removal operation, the ejector closes the opening of the ice bank based on output from the sensor.

In another aspect, a refrigerator includes an ice maker configured to make ice, a dispenser configured to dispense ice, and an ice bank that is configured to store ice made by the ice maker and that has an opening that that enables passage of ice from within the ice bank to the dispenser. The refrigerator also includes an input part that is configured to receive an operation signal to dispense ice using the dispenser and an ejector that is configured to open and close the opening based on the operation signal and that is configured to rotate to promote movement of ice from within the ice bank toward the opening based on the operation signal. The refrigerator further includes a sensor that is configured to sense a position of the ejector relative to the opening of the ice bank and a controller that is configured to, in response to completion of an ice dispensing operation controlled by the operation signal, determine whether the ejector closes the opening of the ice bank based on output from the sensor and that is configured to, in response to a determination that the ejector does not close the opening of the ice bank, control the ejector to rotate to a position in which the ejector closes the opening of the ice bank.

Implementations may include one or more of the following features. For example, the ejector may include a plurality of blades that extend radially from a center of a rotation shaft of the ejector. The sensor may include a magnet provided on one of the ice bank and a blade of the ejector and a hall sensor that is provided on the other of the ice bank and the blade of the ejector and that is configured to sense strength of an electric field of the magnet.

In some implementations, the ejector may be configured to rotate in a first direction to promote movement of ice from within the ice bank toward the opening based on the operation signal. In these implementations, the controller may be configured to, in response to a determination that the ejector does not close the opening of the ice bank, control the ejector to rotate in a second direction to the position in which the ejector closes the opening of the ice bank. The second direction may be opposite of the first direction.

The input part may include a lever that is provided on the dispenser and that is configured to receive user input and generate the operation signal based on the user input.

In yet another aspect, a controlling method of an ice making apparatus includes controlling an ejector to open an opening of an ice bank and to promote movement of ice stored in the ice bank toward the opening. The method also includes controlling the ejector stop at a first position when dispensing of ice is completed and determining whether the ejector closes the opening of the ice bank in the first position. In response to a determination that the ejector does not close the opening of the ice bank in the first position, the ejector is controlled to move from the first position to a second position in which the ejector closes the opening of the ice bank.

Implementations may include one or more of the following features. For example, the method may include sensing, using a sensor, a position of the ejector relative to the opening of the ice bank when the ejector is positioned in the first position and determining whether the ejector closes the opening of the ice bank in the first position based on the sensed position of the ejector relative to the opening of the ice bank. The method also may include controlling the ejector to remain in the first position in response to a determination that the ejector closes the opening of the ice bank in the first position.

The method further may include controlling the ejector to rotate in a first direction and controlling the ejector to rotate in a second direction that is opposite of the first direction.

In some examples, the method may include determining whether ice interferes with movement of the ejector from the first position to the second position in which the ejector closes the opening of the ice bank and, in response to a determination that ice interferes with movement of the ejector from the first position to the second position in which the ejector closes the opening of the ice bank, controlling the ejector to perform an ice removal operation in which the ejector moves alternately in a first direction and a second direction that is opposite of the first direction. In these examples, the method may include determining whether, subsequent to completion of the ice removal operation, ice continues to interfere with movement of the ejector from the first position to the second position in which the ejector closes the opening of the ice bank and controlling a warning part to display an error message in response to a determination that, subsequent to completion of the ice removal operation, ice continues to interfere with movement of the ejector from the first position to the second position in which the ejector closes the opening of the ice bank.

The details of one or more implementations are set forth in the accompanying drawings and the description below. Other features will be apparent from the description and drawings, and from the claims.

DETAILED DESCRIPTION

Figure 1:
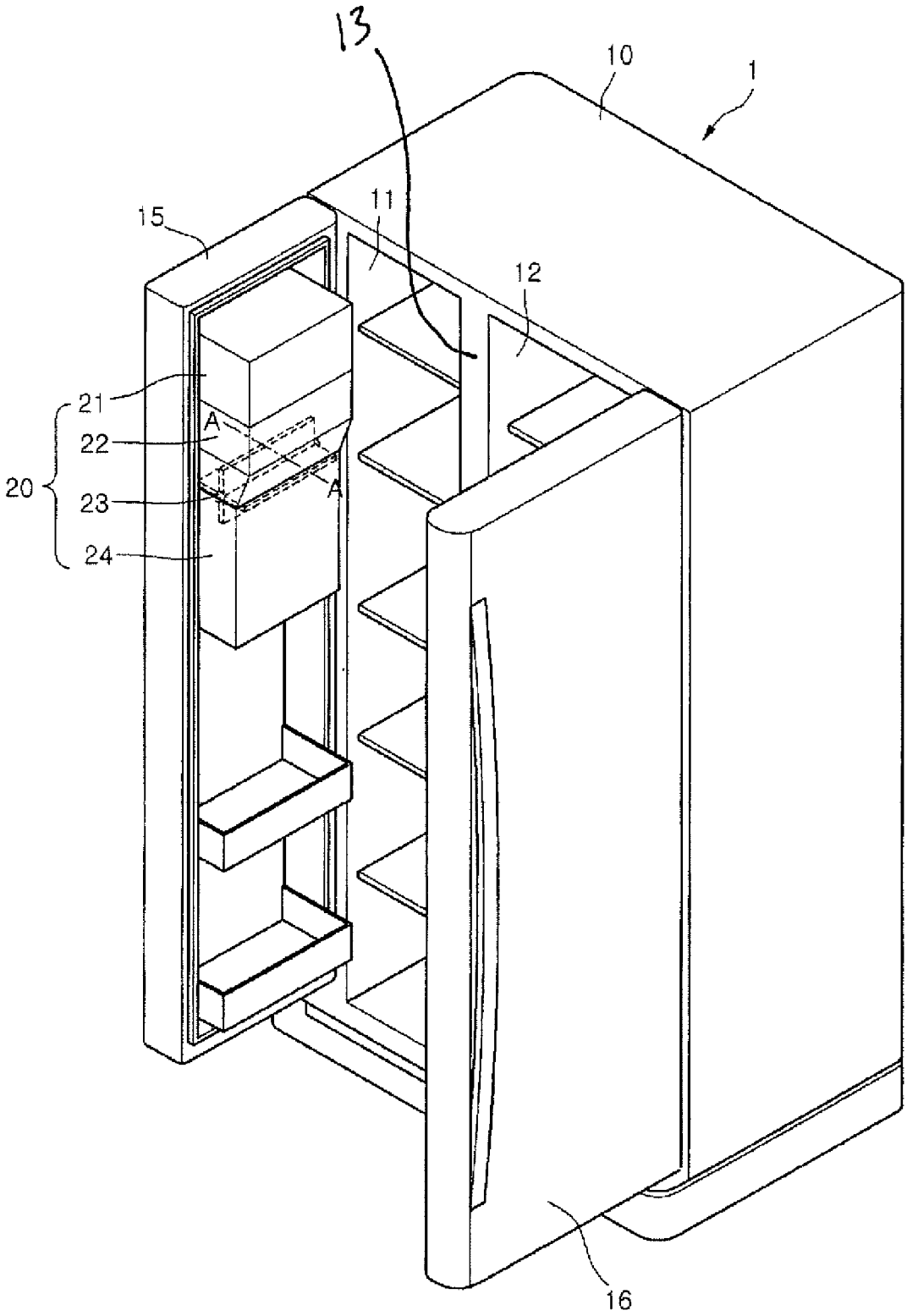
FIG. 1 is a front perspective view of a refrigerator.
Figure 2:
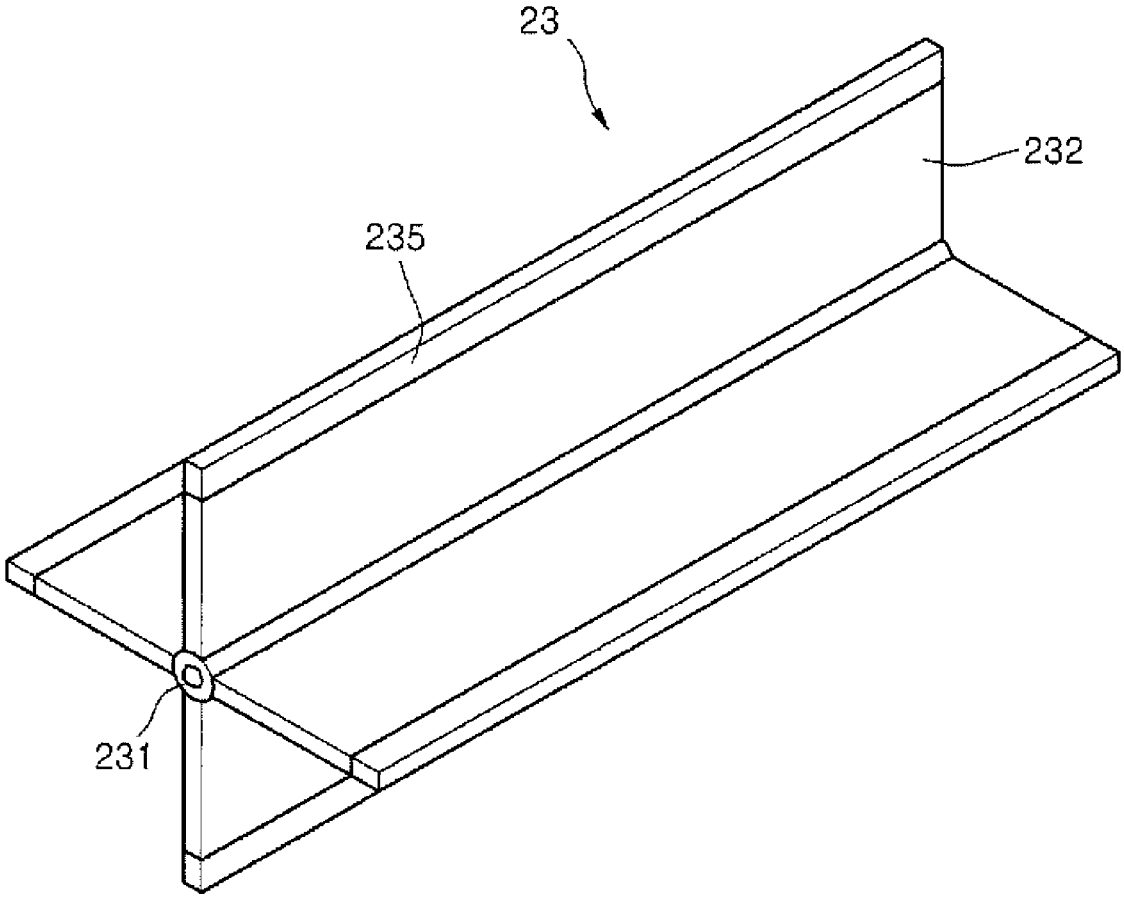
FIG. 2 is a perspective view of an ejector.

FIG. 1 illustrates an example of a refrigerator, and FIG. 2 illustrates an example of an ejector.

Referring to FIGS. 1 and 2, the refrigerator 1 includes a main body 10 that includes a refrigeration cycle apparatus, and an ice making apparatus 20 that makes ice and allows the ice to be taken out to the exterior of the refrigerator 1 by an operation of a user.

The inside of the main body 10 includes a freezing chamber 11 and a refrigerating chamber 12 in which foods are preserved in a cold storage at a low temperature by the refrigeration cycle apparatus. The freezing chamber 11 maintains a temperature at or below freezing and, thereby, stores foods in a frozen state. The refrigerating chamber 12 maintains a temperature above freezing, but below typical ambient or room temperature (e.g., between 0° C. to 10° C.). The refrigerating chamber stores foods in a cool or refrigerated state. The spaces of the freezing chamber 11 and the refrigerating chamber 12 are partitioned by a barrier 13. A freezing chamber door 15 and a refrigerating chamber door 16 that selectively open and close the freezing chamber 11 and the refrigerating chamber 12, respectively, are provided on both sides of the main body 10. The other ends of the freezing chamber door 15 and the refrigerating chamber door 16 are installed to enable forward and backward rotation with a center of rotation at or near an end of the door.

Meanwhile, the ice making apparatus 20 is mounted on a back side of the freezing chamber door 15. The ice making apparatus 20 makes ice using cold air of the freezing chamber 11 and allows the ice to be taken out to the outside of the refrigerator 1. Although the ice making apparatus 20 is described to be provided on the back side of the freezing chamber door 15 in the example shown in FIG. 1, it also may be provided on the refrigerating chamber door 16 depending on the design and constitution of the refrigerator 1.

The ice making apparatus 20 includes an ice maker 21, an ice bank 22, an ejector 23, and a dispenser 24.

The ice maker 21 includes a tray (not shown) with a cube (not shown) partitioned into a plurality of spaces within the tray, wherein water stored within the cube of the ice maker 21 is frozen into ice by the cold air of the freezing chamber 11. The ice maker 21 supplies the produced ice to the ice bank 22 provided on below the ice maker 21.

The ice bank 22 stores the ice supplied from the ice maker 21 and allows the ice to be taken out to the outside of the refrigerator 1 through the dispenser 24, if an ice supply signal is input to the refrigerator 1. Also, the ice bank 22 is separable from the ice making apparatus 20, such that, when a user needs a large quantity of ice, he or she can use the ice by separating the ice bank 22 from the ice making apparatus 20 without passing the ice through the dispenser 24.

The dispenser 24 includes an ice duct that defines an ice flow passage through the freezing chamber door 15. The ice duct provides a supply path of the ice during the process where the ice ejected from the ice bank 22 is supplied to the outside of the refrigerator 1.

The ejector 23 is provided in the space where the ice bank 22 contacts the dispenser 24 and is configured to eject ice in the ice bank 22 to the dispenser 24. In addition, when ice is not being ejected from the ice bank 22 to the dispenser 24, the ejector 23 shields the ice bank 22 against the dispenser 24 to reduce an amount of cold air from the ice bank 22 that escapes to the outside of the refrigerator 1 through the dispenser 1. For instance, the ejector 23 prevents or blocks passage of cold air from the ice bank 22 to the dispenser 24 when the ejector 23 is not being used to eject ice.

Referring to FIG. 2, the ejector 23 includes a rotation shaft 231 that provides a rotation center when the ejector 23 is driven, and a plurality of blades 232 that extend radially from the rotation shaft 231. In some examples, a magnet 235 is located at ends of the respective blades 232.

Figure 3:
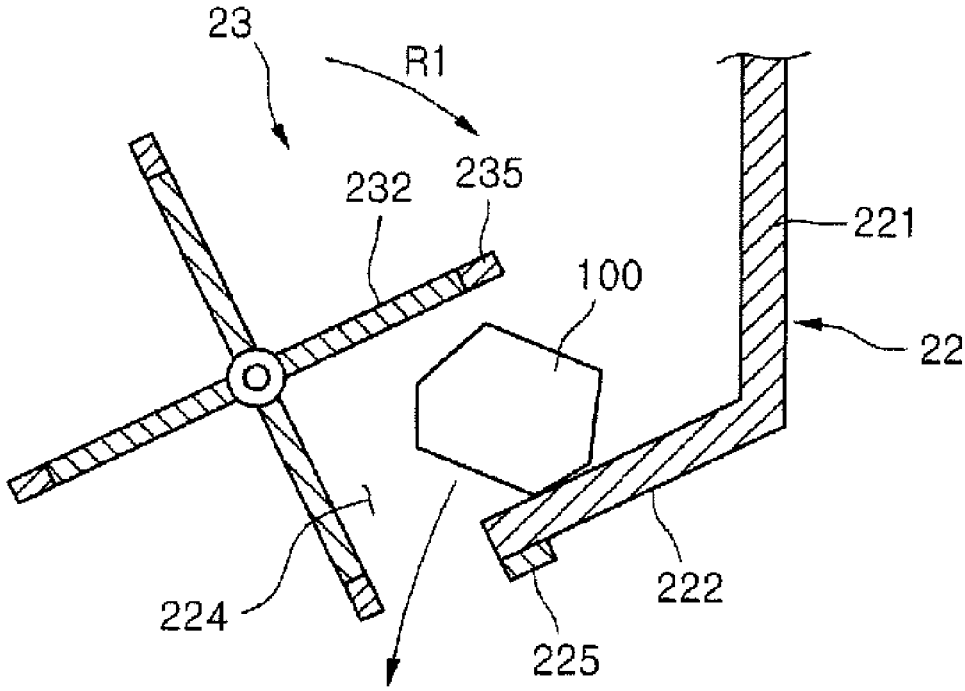
FIG. 3 is a schematic cross-sectional view taken along line A-A of FIG. 1 in a state where the ice bank is opened by the ejector.
Figure 4:
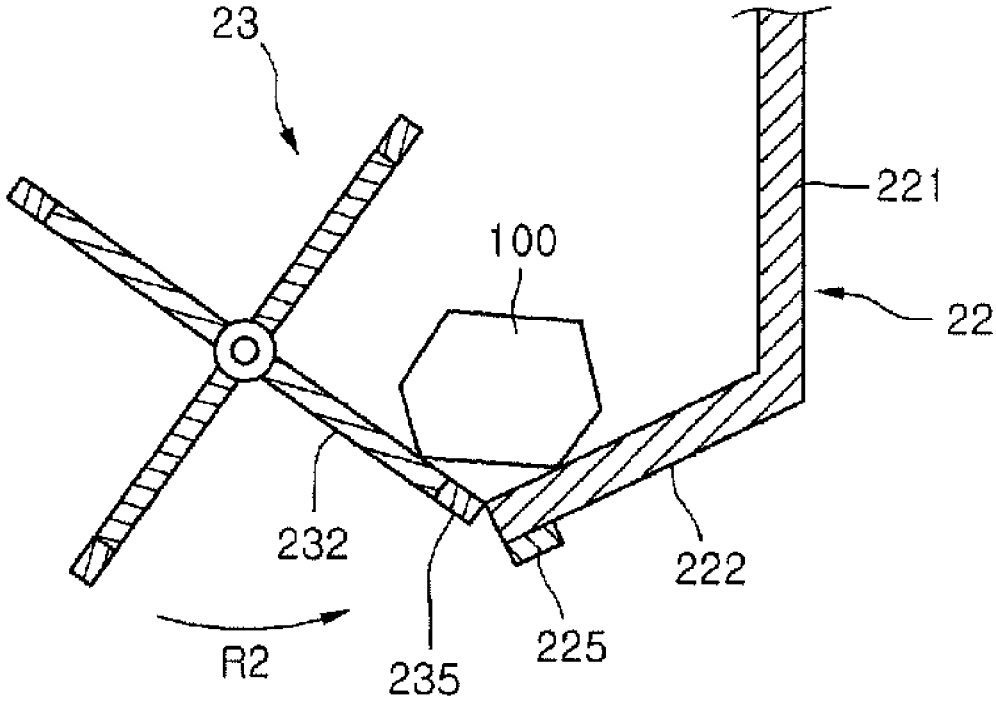
FIG. 4 is a schematic cross-sectional view taken along line A-A of FIG. 1 in a state where the ice bank is closed by the ejector.

FIG. 3 illustrates a cross-section of an example ice making apparatus 20 taken along line A-A of FIG. 1 in a state where the ice bank 22 is opened by the ejector 23. FIG. 4 illustrates a cross-section of an example ice making apparatus 20 taken along line A-A of FIG. 1 in a state where the ice bank 22 is closed by the ejector 23.

Referring to FIGS. 3 and 4, the ice bank 22 includes a housing 221 that defines an external appearance of the ice bank 22 and stores ice 100 therein. The housing 221 includes an inclined portion 222 that is located on a lower side of the housing 221 and is inclined at a predetermined angle. The housing 221 also includes an opening 224 defined on an end side of the inclined portion 222. The inclined portion 222 guides ice 100 stored in the ice bank 22 toward the opening 224 by the force of gravity. A hall sensor 225 is provided on an end of the inclined portion 222. The hall sensor 225 senses the magnet 235 of the blade 232 to determine a position of the blade 232 relative to the end of the inclined portion 222. In this example, the hall sensor 225 and the magnet 235 constitute a sensing part that determines the position of the blade 232.

The inclined portion 222 that defines the bottom surface of the ice bank 22 is inclined downwardly at a predetermined angle. Therefore, if the ice 100 contacts the inclined portion 222, the ice 100 is guided toward the opening 224 by its own weight.

The ice making apparatus 20 further includes a controller (not shown) that drives the ejector 23 depending on an ice dispensing signal input at a user input control positioned at an exterior portion of the refrigerator 1 and the position of the blade 232 relative to the end of the inclined portion 222 sensed by the hall sensor 225.

During the process where the ice is dispensed from the dispenser 24, the ejector 23 is driven to eject the ice 100 within the ice bank 22 toward the dispenser 24. More specifically, while the ice is being dispensed from the dispenser 24, the ejector 23 is rotated in a first direction (R1). As the ejector 23 is rotated, the plurality of blades 232 contact ice 100 positioned on the inclined portion 222 and promote movement of the ice 100 toward the opening 224. The ice 100 moved to the opening 224 falls through the opening 224 and then is dispensed to the exterior of the refrigerator 1 through the dispenser 24, which is provided below the ice bank 22.

When the ice dispensing operation of the ice 100 is completed, the ejector 23 shields the opening 224. Shielding the opening 224 obstructs (e.g., blocks, prevents, etc.) ice 100 from being ejected from the ice bank 22 to the dispenser 24.

More specifically, the blade 232 of the ejector 23 has a size corresponding to the size of the opening 224. The hall sensor 225, which is provided adjacent to the opening 224, senses the magnet 235 located on the end of the blade 232 and, thereby, senses the relative position of the blade 232 against the opening 224.

For example, when the dispensing operation of ice 100 is completed, the hall sensor 225 senses the position of the blade 232 relative to the opening 224. Based on the sensed position of the blade 232 relative to the opening 224, the controller drives the ejector 23 so that a blade 232 (e.g., one of the multiple blades of the ejector 23) is positioned to shield the opening 224. For instance, the ejector 23 is driven in a second direction (R2) to a position in which a blade 232 shields or covers the opening 224. The second direction (R2) is different than the first direction (R1) in which the ejector 23 is rotated to eject ice 100. By rotating the ejector 23 in the second direction (R2) when attempting to shield or cover the opening 224 after dispensing of ice is complete, the controller controls the ejector 23 to rotate in a direction that is less likely to cause ejection of ice 100 through the opening 224 because the ejector 23 pushes ice 100 positioned on the inclined portion 222 away from the opening 224 when rotated in the second direction (R2).

Figure 5:
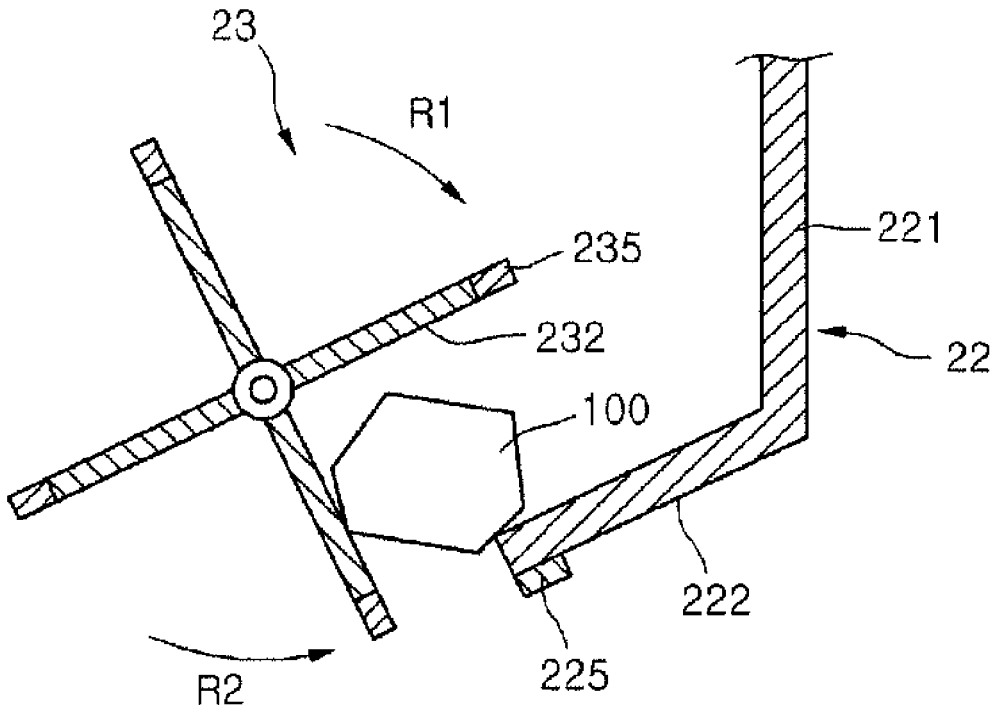
FIG. 5 is a cross-sectional view showing an example where ice that is interfering operation of an ejector is removed.

FIG. 5 illustrates a cross-section of an example ice making apparatus 20 showing an example of removing ice that interferes with the operation of an ejector. Referring to FIG. 5, when the ice 100 is lodged between the opening 224 and the ejector 23 when the ejector 23 is being rotated to shield the opening 224, the driving of the ejector 23 may be interfered with by the ice 100. For instance, as the ice 100 contacts the blade 232, the ice 100 interferes with the rotation of the ejector 23 in the direction (R2), as shown.

When the ejector 23 does not rotate even though power is supplied to the ejector 23 for a predetermined period of time, the controller senses the interference. In response to sensing the interference, the controller controls the ejector 23 to alternately rotate in a first direction (R1) and a second direction (R2). At this time, the driving of the ejector 23 is referred to as an ice removal operation. The ice 100 commonly interferes the driving of the ejector 23 in a certain direction, such that, if the ejector 23 is driven in the opposite direction, the ice 100 dislodges, falls through the opening 224, and no longer interferes with rotation of the ejector 23 in shielding the opening 224.

If the ice 100 is not removed even though the ice removal operation of the ejector 23 is performed at a predetermined operation frequency (e.g., the ejector 23 is rotated back and forth a predetermined number of times), an error message is displayed through a warning part provided on an external surface of the refrigerator 1. Therefore, a user is alerted to a state where the ice 100 is stuck at a position that prevents shielding of the opening 224 and is able to address the problem.

Although the hall sensor 225 has been described as being provided on the ice bank 22, in other implementations, the hall sensor 225 may be provided on the ejector 23 side and the magnet 235 may be provided on the ice bank 22 side. In some implementations, the sensing part used to sense a position of the blade 232 relative to the opening 224 is another type of sensor, such as a position sensor, an infrared sensor, etc.

Figure 6:
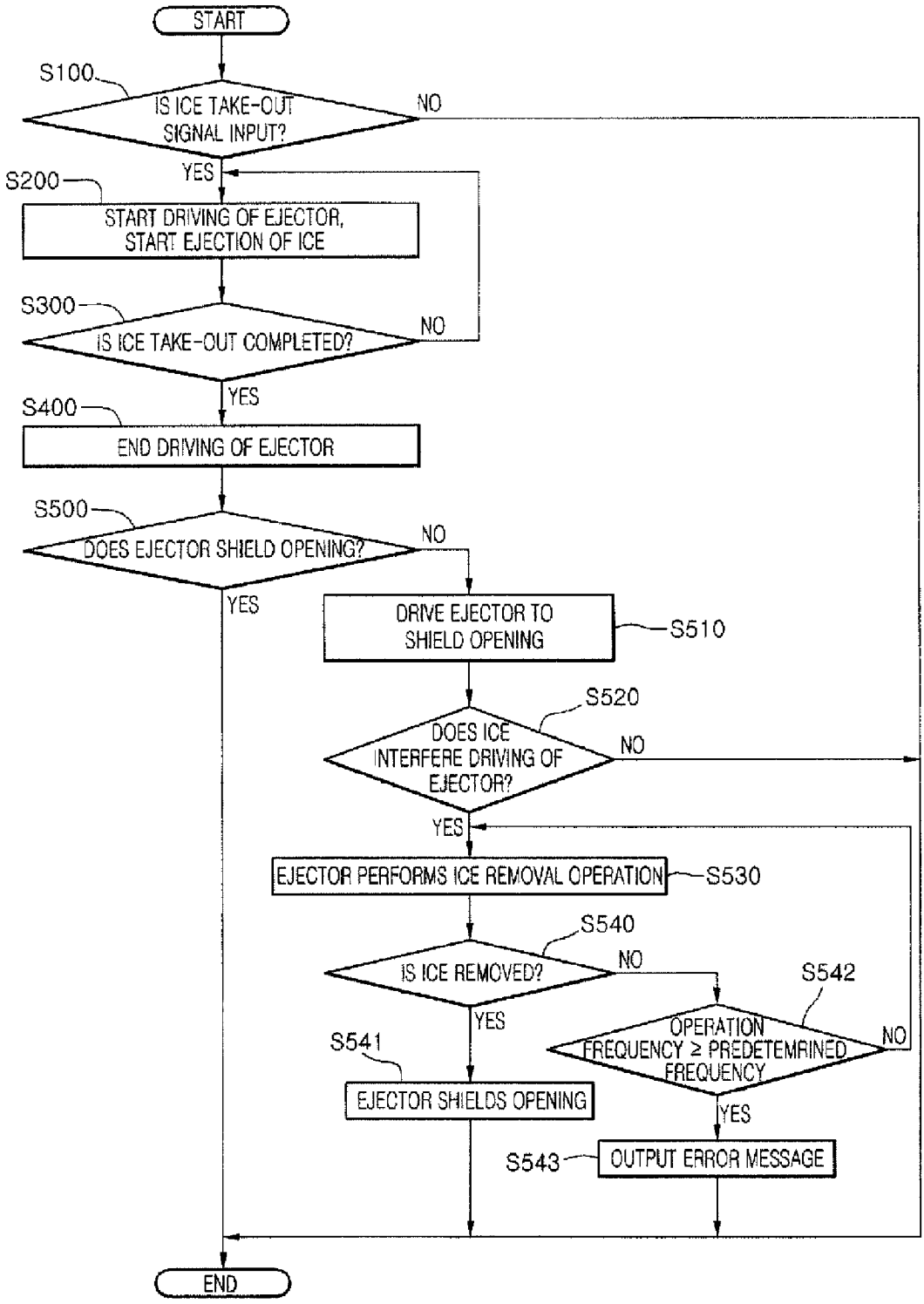
FIG. 6 is a flowchart showing a controlling method of an ice making apparatus.

FIG. 6 illustrates an example of a controlling method of an ice making apparatus. Referring to FIG. 6, it is determined whether an ice dispensing signal is input to the ice making apparatus 20 (S100). The ice dispensing signal may be input when a lever provided on the dispenser 24 or a user input button is pressed.

If the ice dispensing signal is input, the ejector 23 starts to be driven (S200). As the ejector 23 is rotated in one direction (R1), the ice 100 is supplied to the dispenser 24 from the ice bank 22 through the opening 224 and then is dispensed to the exterior of the refrigerator (S200).

It is determined whether the input of the ice dispensing signal is completed (S300). If the input of the ice dispensing signal is completed, the driving of the ejector 23 is completed (S400).

If the driving of the ejector 23 is completed, the hall sensor 225 senses the relative position of the ejector 23 against the opening 224, and the controller determines whether the opening 224 is shielded based on the relative position of the ejector 23 (S500).

When the opening 224 is not shielded, the ejector 23 is driven in the opposite direction (R2) toward a position in which the opening 224 is shielded (S510).

At this time, it is determined whether the driving of the ejector 23 is interfered with by the ice 100 (S520). For example, the controller determines whether the driving of the ejector 23 is interfered with by the ice 100 based on whether the ejector 23 has not rotated to a position in which a blade 232 shields the opening 224, even though power has been supplied to the ejector 23 for a predetermined period of time. In other examples, the ice making apparatus 20 may include a sensor configured to sense whether ice 100 is positioned between a blade 232 and the edge of the inclined portion 222 and the controller determines whether the driving of the ejector 23 is interfered with by the ice 100 based on output from the sensor.

When the driving of the ejector 23 is not interfered with by the ice 100, it is determined whether the opening 224 is shielded. When the opening 224 is shielded, the driving of the ejector 23 is stopped and the control thereof is completed.

If it is determined that the driving of the ejector 23 is interfered with by the ice 100, the ice removal operation of the ejector 23 is performed (S530). For instance, the ice removal operation of the ejector 23 may include the ice removal operation described above with respect to FIG. 5.

After the ice removal operation is performed, it is determined whether the ice 100 is removed from the opening 224 (S540). For instance, the controller determines whether the ice 100 is removed from the opening 224 using techniques described above with respect to reference numeral (S520).

When the ice 100 is removed and the ejector 23 is able to be driven to shield the opening 224, the ejector is not interfered with and is driven to shield the opening 224 (S541). When the ice 100 is not removed (S540), it is determined whether the ice removal operation has been performed at a predetermined frequency (S542).

When the ice 100 is not removed although the ice removal operation is performed at the predetermined operation frequency, an error message is displayed to allow a user to recognize the state of the ice that is inserted into the opening 224 (S543). When the ice 100 is not removed and the ice removal operation has not been performed at the predetermined operation frequency, the ice removal operation is performed again.

In some implementations, the state where the ice bank 22 is shielded against the dispenser 24 is maintained by the ejector 23, excepting for the case where the ice dispensing operation of the ice making apparatus 20 is performed. This may reduce unnecessary and unwanted ejection of the ice 100 from the dispenser 24.

Also, when the operation of the ejector 23 is interfered with by the ice 100 during the shielding process of the opening 224, the ice 100 is removed to enable shielding of the opening 224. This may reduce the likelihood of the ejector 23 being overloaded.

Also, in some examples, the ejection of ice and the opening and closing of the opening is simultaneously performed by the ejector. This may reduce an amount of air that escapes through the dispenser 24 during a dispensing operation.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. An ice making apparatus for a refrigerator, comprising:
- an ice maker configured to make ice;
- a dispenser configured to dispense ice;
- an ice bank that is configured to store ice made by the ice maker and that has an opening that enables passage of ice from within the ice bank to the dispenser;
- an ejector that is configured to open and close the opening and that is configured to rotate to promote movement of ice from within the ice bank toward the opening, the ejector being disposed within the ice bank;
- a sensor that is configured to sense a position of the ejector relative to the opening of the ice bank; and
- a controller that is configured to, in response to completion of an ice dispensing operation:
  - stop rotation of the ejector;
  - determine whether the ejector closes the opening of the ice bank based on output from the sensor;
  - in response to a determination that the ejector does not close the opening of the ice bank, control the ejector to rotate to a position in which the ejector closes the opening of the ice bank; and
  - in response to a determination that the ejector closes the opening of the ice bank, control the ejector to maintain its position which closes the opening of the ice bank.

2. The ice making apparatus for the refrigerator according to claim 1, wherein the ejector includes a plurality of blades that extend radially from a center of a rotation shaft of the ejector.

3. The ice making apparatus for the refrigerator according to claim 1, wherein the sensor includes:
- a magnet provided on one of the ice bank and the ejector; and
- a hall sensor that is provided on the other of the ice bank and the ejector and that is configured to sense strength of a magnetic field of the magnet.

4. The ice making apparatus for the refrigerator according to claim 1, wherein the ice bank includes:
- a housing that defines an external appearance of the ice bank and that defines a space in which ice is stored; and
- an inclined portion that defines a bottom surface of the ice bank and that is inclined in a manner that guides ice stored in the ice bank toward the opening by force of gravity.

5. The ice making apparatus for the refrigerator according to claim 1, wherein the ejector is configured to rotate in a first direction to promote movement of ice from within the ice bank toward the opening.

6. The ice making apparatus for the refrigerator according to claim 5, wherein the controller is configured to, in response to a determination that the ejector does not close the opening of the ice bank, control the ejector to rotate in a second direction to a position in which the ejector closes the opening of the ice bank, the second direction being opposite of the first direction.

7. The ice making apparatus for the refrigerator according to claim 1, wherein, when the controller controls the ejector to rotate to a position in which the ejector closes the opening of the ice bank, the controller is configured to determine whether ice interferes with rotation of the ejector to the position in which the ejector closes the opening of the ice bank and the controller is configured to, in response to a determination that ice interferes with rotation of the ejector to the position in which the ejector closes the opening of the ice bank, control the ejector to perform an ice removal operation in which the ejector rotates alternately in a first direction and a second direction that is opposite of the first direction.

8. The ice making apparatus for the refrigerator according to claim 7, wherein the controller is configured to determine whether, subsequent to completion of the ice removal operation, ice continues to interfere with rotation of the ejector to the position in which the ejector closes the opening of the ice bank, further comprising:

a warning part that is configured to display an error message in response to a determination that, subsequent to completion of the ice removal operation, ice continues to interfere with rotation of the ejector to the position in which the ejector closes the opening of the ice bank.

9. The ice making apparatus for the refrigerator according to claim 7, wherein the controller is configured to determine whether, subsequent to completion of the ice removal operation, the ejector closes the opening of the ice bank based on output from the sensor.

10. A refrigerator, comprising:

an ice maker configured to make ice;

a dispenser configured to dispense ice;

an ice bank that is configured to store ice made by the ice maker and that has an opening that that enables passage of ice from within the ice bank to the dispenser;

an input part that is configured to receive an operation signal to dispense ice using the dispenser;

an ejector that is configured to open and close the opening based on the operation signal and that is configured to rotate to promote movement of ice from within the ice bank toward the opening based on the operation signal, the ejector being disposed within the ice bank;

a sensor that is configured to sense a position of the ejector relative to the opening of the ice bank; and a controller that is configured to, in response to completion of an ice dispensing operation controlled by the operation signal:

stop rotation of the ejector;

determine whether the ejector closes the opening of the ice bank based on output from the sensor;

in response to a determination that the ejector does not close the opening of the ice bank, control the ejector to rotate to a position in which the ejector closes the opening of the ice bank; and in response to a determination that the ejector closes the opening of the ice bank, control the ejector to maintain its position which closes the opening of the ice bank.

11. The refrigerator according to claim 10, wherein:

the ejector includes a plurality of blades that extend radially from a center of a rotation shaft of the ejector, and the sensor includes:

a magnet provided on one of the ice bank and a blade of the ejector; and a hall sensor that is provided on the other of the ice bank and the blade of the ejector and that is configured to sense strength of a magnetic field of the magnet.

12. The refrigerator according to claim 10, wherein the ejector is configured to rotate in a first direction to promote movement of ice from within the ice bank toward the opening based on the operation signal.

13. The refrigerator according to claim 12, wherein the controller is configured to, in response to a determination that the ejector does not close the opening of the ice bank, control the ejector to rotate in a second direction to the position in which the ejector closes the opening of the ice bank, the second direction being opposite of the first direction.

14. The refrigerator according to claim 10, wherein the input part includes a lever that is provided on the dispenser and that is configured to receive user input and generate the operation signal based on the user input.

15. A controlling method of an ice making apparatus, comprising:

controlling an ejector to open an opening of an ice bank and to promote movement of ice stored in the ice bank toward the opening;

controlling the ejector stop at a first position when dispensing of ice is completed;

determining whether the ejector closes the opening of the ice bank in the first position;

in response to a determination that the ejector does not close the opening of the ice bank in the first position, controlling the ejector to move from the first position to a second position in which the ejector closes the opening of the ice bank; and in response to a determination that the ejector closes the opening of the ice bank in the first position, control the ejector to maintain the first position which closes the opening of the ice bank.

16. The controlling method of the ice making apparatus according to claim 15, wherein determining whether the ejector closes the opening of the ice bank in the first position comprises:

sensing, using a sensor, a position of the ejector relative to the opening of the ice bank when the ejector is positioned in the first position; and determining whether the ejector closes the opening of the ice bank in the first position based on the sensed position of the ejector relative to the opening of the ice bank.

17. The controlling method of the ice making apparatus according to claim 16, further comprising:

controlling the ejector to remain in the first position in response to a determination that the ejector closes the opening of the ice bank in the first position.

18. The controlling method of the ice making apparatus according to claim 15, wherein:

controlling the ejector to open the opening of the ice bank and to promote movement of ice stored in the ice bank toward the opening comprises controlling the ejector to rotate in a first direction; and controlling the ejector to move from the first position to the second position in which the ejector closes the opening of the ice bank comprises controlling the ejector to rotate in a second direction that is opposite of the first direction.

19. The controlling method of the ice making apparatus according to claim 15, wherein controlling the ejector to move from the first position to the second position in which the ejector closes the opening of the ice bank comprises:

determining whether ice interferes with movement of the ejector from the first position to the second position in which the ejector closes the opening of the ice bank; and in response to a determination that ice interferes with movement of the ejector from the first position to the second position in which the ejector closes the opening of the ice bank, controlling the ejector to perform an ice removal operation in which the ejector moves alternately in a first direction and a second direction that is opposite of the first direction.

20. The controlling method of the ice making apparatus according to claim 19, further comprising:

determining whether, subsequent to completion of the ice removal operation, ice continues to interfere with movement of the ejector from the first position to the second position in which the ejector closes the opening of the ice bank; and controlling a warning part to display an error message in response to a determination that, subsequent to completion of the ice removal operation, ice continues to interfere with movement of the ejector from the first position to the second position in which the ejector closes the opening of the ice bank.

* * * * *